US006158052A

United States Patent [19]

Smith

[11] Patent Number: 6,158,052

[45] Date of Patent: Dec. 12, 2000

[54] TRAY FOR SUSPENDING FROM THE NECK, IMMEDIATELY BELOW THE CHIN, FOR HOLDING FOOD WITHOUT THE USE OF HANDS

[76] Inventor: Ross W. Smith, 109 Montair Dr., Danville, Calif. 94526

[21] Appl. No.: 09/246,585

[22] Filed: Feb. 8, 1999

[51] Int. Cl.[7] ..... A41B 13/10

[52] U.S. Cl. ..... 2/46; 2/48

[58] Field of Search ..... 2/46, 48, 49.1, 2/49.2, 49.3

[56] References Cited

U.S. PATENT DOCUMENTS

| | | | |
|---|---|---|---|
| D. 323,435 | 1/1992 | Palacios | D6/406 |
| D. 325,115 | 4/1992 | Vassar, Sr. | D2/229 |
| 996,084 | 6/1911 | Herring | 2/48 |
| 1,592,283 | 7/1926 | McKenzie | 2/48 |
| 3,822,473 | 7/1974 | Jones | 32/17 |
| 4,114,199 | 9/1978 | Malan | 2/49 A |
| 4,985,932 | 1/1991 | Bezdek | 2/49 A |
| 5,056,159 | 10/1991 | Zemke, Jr. | 2/49 A |
| 5,062,558 | 11/1991 | Stang | 224/270 |
| 5,074,222 | 12/1991 | Welch | 108/43 |
| 5,285,940 | 2/1994 | Goutler | 224/270 |
| 5,459,877 | 10/1995 | Roberti | 2/104 |
| 5,701,605 | 12/1997 | Bowen | 2/49.1 |

*Primary Examiner*—Bibhu Mohanty
*Attorney, Agent, or Firm*—Richard L. Miller, P. E

[57] ABSTRACT

A device for suspending from the neck, immediately below the chin, and for minimizing dribbling, dropping, and spilling of food, without use of hands. The device includes a suspender that hooks the neck and a tray that is suspended from the suspender and holds the food. The suspender is tubular and made from a semi-rigid wire that is enclosed in a foam material. The suspender includes a first portion that extends horizontally to a second portion that extends horizontally forwardly from the first portion, to a third portion that extends horizontally from the second portion, to a fourth portion that extends horizontally from the third portion and which define an opening. A fifth portion is pivotally mounted to the fourth portion, by a pivot joint, and extends generally upwardly therefrom in a hook-like fashion for hooking the neck. The pivot joint includes a first collar that is disposed on the fourth portion and a second collar that is disposed on the fifth portion, and which is pivotally mounted to the first collar, by a pivot pin. The tray includes a receptacle that is sized to fit in the opening in the suspender for holding the food, and a flange that extends around the receptacle, and which interchangeably rests on the first through fourth portions of the suspender to prevent the receptacle from falling through the opening in the suspender.

18 Claims, 2 Drawing Sheets

TRAY FOR SUSPENDING FROM THE NECK, IMMEDIATELY BELOW THE CHIN, FOR HOLDING FOOD WITHOUT THE USE OF HANDS

CROSS REFERENCE TO RELATED APPLICATIONS

The instant application contains subject matter disclosed in applicant's Disclosure Document No. 436175 filed in May 1988, and as such, it is respectfully requested in a separate letter that this Disclosure Document be incorporated with and remain a permanent part of the file history so that it may be relied upon during the prosecution of the instant application and during any subsequent action thereafter.

BACKGROUND OF THE INVENTION

1. Field of the Invention

The present invention relates to a tray. More particularly, the present invention relates to a tray for suspending from the neck, immediately below the chin, and for minimizing dribbling, dropping, and spilling of food, without the use of hands.

2. Description of the Prior Art

Numerous innovations for combination bibs and trays have been provided in the prior art that will be described. Even though these innovations may be suitable for the specific individual purposes to which they address, however, they differ from the present invention.

A FIRST EXAMPLE, U.S. Pat. No. Des. 323,435 to Palacios teaches the ornamental design for a combined lap tray and bib.

A SECOND EXAMPLE, U.S. Pat. No. Des. 325,115 to Vassar, Sr. teaches the ornamental design for a combination bib and lap tray.

A THIRD EXAMPLE, U.S. Pat. No. 3,822,473 to Jones teaches a bib for a bit registration tray that has a paste supporting strip of soft, flexible, open mesh material, its lateral margins embedded in resilient snap fastening channels of set plastic material. Embedding of the margins is effected during molding of the channels. The channels are coextensive in length with the strip and each ha a restricted entry passage with guide walls flaring outwardly from the passage, so that the channels can be snapped easily onto laterally spaced wire frame members, respectively, of a bit registration tray in a direction radially of the frame members for holding the strip in bridging relation to the space between the wire frame members. The channels are of such resiliency and the strip is so connected thereto that the strip can be adjusted for slack or tensioned condition by rotating one or both of the channels about the axes of the frame members, respectively. The gripping power of the channels is such that, coupled with the lengthwise curvature of the frame members and resilient warpage of the channels, the channels remain in the adjusted position to which they have been rotated, and thus retain the strip with the selected degree of slackness or tension. The bibs are produced in multiple by a new method.

A FOURTH EXAMPLE, U.S. Pat. No. 4,114,199 to Malan teaches a bib-tray structure for use during the feeding of an infant that is fabricated from suitable stiff and tear resistant thin sheet material such as paper cut and folded so as to comprise a bib portion, a tray portion, and an interconnecting transition region having accordion folds adapted to provide adjustability of height of the structure. The bib portion contains neck straps which are adjustably interengageable. The tray portion contains borders which permit facile assembly of a serving surface bounded by retaining walls.

A FIFTH EXAMPLE, U.S. Pat. No. 4,985,932 to Bezdek teaches an improved food spill catching device with folded straps mounted in a tray portion for attaching the device around the neck of a person is described. The device is preferably provided by forming the straps and trays separately as preforms which are then assembled and formed into the device.

A SIXTH EXAMPLE, U.S. Pat. No. 5,056,159 to Zemke, Jr. teaches a tray-bib that has a tray portion covering a wearer's lap and a bib portion covering a wearer's chest and stomach. The tray forms a cavity with a bottom, sides, and ends. The bib portion tears along perforations and folds up from a top portion of the tray to direct spillage into the tray. The bib portion also has a collar portion which fits around the neck of the wearer to support the bib. The sides and ends retain the spilled debris in the tray so that it does not spill onto the seat or wearer's lap.

A SEVENTH EXAMPLE, U.S. Pat. No. 5,062,558 to Stang teaches a food tray and bib system which is adapted to be removably coupled to the neck of a user's body. The food tray and bib system includes a flexibly collapsible housing and bib assembly having a deformable cavity for receipt of a tray assembly. Housing and bib assembly includes a rear wall having a lower portion defining a rear wall of the deformable cavity, and an upper portion extending longitudinally from deformable cavity a predetermined distance to define a bib-like structure. Upper portion of rear wall includes an arcuate cut-out portion whose perimeter is defined by a pair of strap members of alternately a through opening may be provided for releasable coupling to the neck of the user's body. The forward portion of deformable cavity is structurally supported by an angular portion integrally formed in each side wall extending from an upper portion of rear wall to a forward perimeter portion of deformable cavity. Tray assembly is formed in a parallel-piped contour and includes a plurality of corner posts for establishing the contour of deformable cavity, subsequent to insertion of tray assembly therein.

A EIGHTH EXAMPLE, U.S. Pat. No. 5,459,877 to Roberti teaches a multi-purpose bib comprised of material and being generally in rectangular form having first and second long edges, first and second short edges, and a first surface and a second surface. One of the long edges of the bib has a neck cut-out portion. An elongated fastener is secured on the first surface, disposed horizontally to a long edge, and located near the corner formed by the intersection of the first long edge and the first short edge. Another elongated fastener is secured to the second surface, disposed horizontally to a long edge, and located near the corner formed by intersection of the second long edge and the first short edge. The two elongated fasteners are releasably securable to each other by hook and loop fasteners and when secured to each other form a cup portion. The material may be water resistant and washable, and there is a means for securing the neck cut-out portion to the neck of an adult or infant. The long and short edges may have decorative eyelet trim for aesthetic purposes.

A NINTH EXAMPLE, U.S. Pat. No. 5,701,605 to Bowen teaches a foldable and reusable bib including a flat relatively stiff sheet having a long axis and a width. The flat sheet includes a transverse fold line, transverse to the long axis and extending across the width of the sheet, thereby dividing the sheet into upper and lower portions. The upper portion is defined by two side edges and a top edge, where the top edge has an arcuate section disposed about the long axis and forming part of an aperture in the flat sheet. The each upper portion side edges slopes and extends from the transverse fold line to the top edge. In another embodiment, the upper portion includes a plurality of angled fold lines proximate each side edge to form a backward folding wing section. Preferably, either bib is made from a recyclable material such as a corrugated paper product.

It is apparent that numerous innovations for combination bibs and trays have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a tray for suspending from the neck, immediately below the chin, and for minimizing dribbling, dropping, and spilling of food, without the use of hands that avoids the disadvantages of the prior art.

ANOTHER OBJECT of the present invention is to provide a tray for suspending from the neck, immediately below the chin, and for minimizing dribbling, dropping, and spilling of food, without the use of hands that is simple and inexpensive to manufacture.

STILL ANOTHER OBJECT of the present invention is to provide a tray for suspending from the neck, immediately below the chin, and for minimizing dribbling, dropping, and spilling of food, without the use of hands that is simple to use.

BRIEFLY STATED, YET ANOTHER OBJECT of the present invention is to provide a device for suspending from the neck, immediately below the chin, and for minimizing dribbling, dropping, and spilling of food, without use of hands. The device includes a suspender that hooks the neck and a tray that is suspended from the suspender and holds the food. The suspender is tubular and made from a semi-rigid wire that is enclosed in a foam material. The suspender includes a first portion that extends horizontally to a second portion that extends horizontally forwardly from the first portion, to a third portion that extends horizontally from the second portion, to a fourth portion that extends horizontally from the third portion and which define an opening. A fifth portion is pivotally mounted to the fourth portion, by a pivot joint, and extends generally upwardly therefrom in a hook-like fashion for hooking the neck. The pivot joint includes a first collar that is disposed on the fourth portion and a second collar that is disposed on the fifth portion, and which is pivotally mounted to the first collar, by a pivot pin. The tray includes a receptacle that is sized to fit in the opening in the suspender for holding the food, and a flange that extends around the receptacle, and which interchangeably rests on the first through fourth portions of the suspender to prevent the receptacle from falling through the opening in the suspender.

The suspender is in the form of a simple S-curve for quick and easy placing around the neck, using only one hand, and by its shape assumes the proper position for its intended function; it does not require fastening devices of any kind.

The suspender is formed by a single piece mold for permitting a manufacturing process which is inexpensive and simple.

The suspender and the tray are created of a material for preventing a personal hazard in a crash.

The suspender and the tray are created of a material for being readily disposable and biodegradable.

The suspender and the tray are created of a material for being readily disposable and biodegradable.

The suspender and the tray are integrally formed of paper-mache-like material for being inexpensive, easily formed, and adequately strong when formed in a U-channel shape, with the paper-mache-like material being similar to the inexpensive trays given away by coffee shops or short-order establishments.

The tray is shaped to include a reservoir for containing drips and spills falling therein.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows.

LIST OF REFERENCE NUMERALS UTILIZED IN THE DRAWING

General

Figure 1:
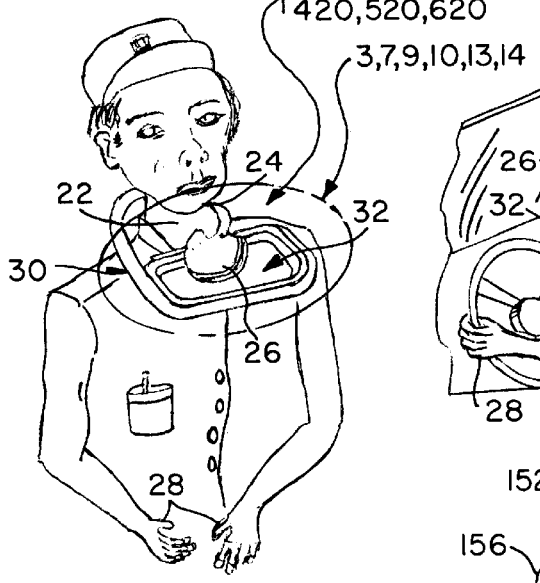
FIG. 1 is a diagrammatic perspective view of the present invention being worn.

20 tray for suspending from the neck, immediately below the chin, and for minimizing dribbling, dropping, and spilling of food, without the use of hands of the present invention
22 neck
24 chin
26 food
28 hands
30 suspender for hooking neck 22
32 tray for holding food 26

First Embodiment

120 tray for suspending from the neck, immediately below the chin, and for minimizing dribbling, dropping, and spilling of food, without the use of hands of the present invention
131 semi-rigid wire for minor adjustments
133 foam material for preventing injury to neck 22
134 first portion
136 free end of first portion 134
138 second portion
140 third portion
142 fourth portion
144 end of fourth portion 142
146 fifth portion
148 one end of fifth portion 146
149 pivot joint
150 free end of fifth portion 146 for hooking neck 22
152 first collar of pivot joint 149
154 second collar of pivot joint 149
156 pivot pin of pivot joint 149
158 opening
160 receptacle for holding food 26
161 open top of receptacle 160
162 flange

Second Embodiment

220 tray for suspending from the neck, immediately below the chin, and for minimizing dribbling, dropping, and spilling of food, without the use of hands of the present invention

Third Embodiment

320 tray for suspending from the neck, immediately below the chin, and for minimizing dribbling, dropping, and spilling of food, without the use of hands of the present invention

Fourth Embodiment

420 tray for suspending from the neck, immediately below the chin, and for minimizing dribbling, dropping, and spilling of food, without the use of hands of the present invention
449 semi-rigid and slightly adjustable bellows for permitting adjustment
464 advertising format

Fifth Embodiment

520 tray for suspending from the neck, immediately below the chin, and for minimizing dribbling, dropping, and spilling of food, without the use of hands of the present invention
566 cat
568 tail of cat 566

Sixth Embodiment

620 tray for suspending from the neck, immediately below the chin, and for minimizing dribbling, dropping, and spilling of food, without the use of hands of the present invention
666 elephant
668 trunk of elephant 666

DETAILED DESCRIPTION OF THE PREFERRED EMBODIMENT

Figure 2:
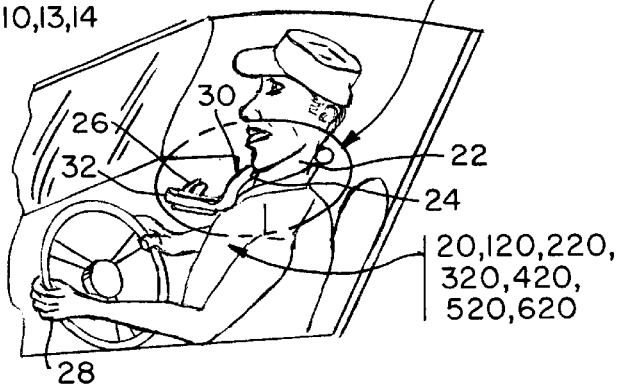
FIG. 2 is a diagrammatic perspective view of the present invention being worn by a driver driving a car.
Figure 6:
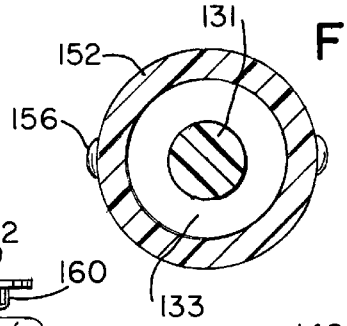
FIG. 6 is an enlarged diagrammatic cross sectional view taken on line 6—6 in FIG. 5.
Figure 4:
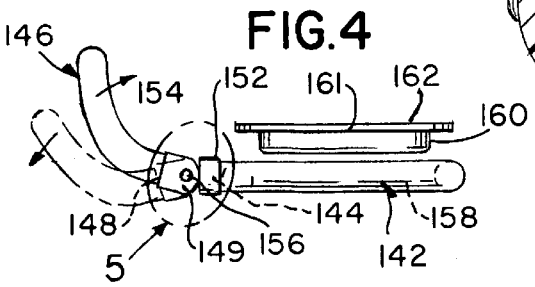
FIG. 4 is an enlarged diagrammatic side elevational view taken generally in the direction of arrow 4 in FIG. 3.
Figure 5:
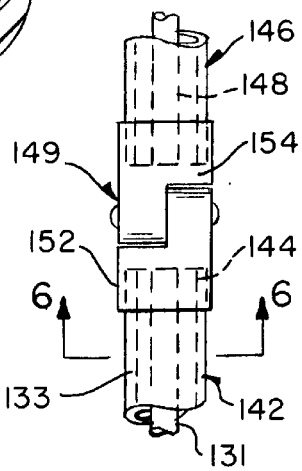
FIG. 5 is an enlarged diagrammatic top plan view of the area generally enclosed by the dotted curve identified by arrow 5 in FIG. 4.

Referring now to the figures, in which like numerals indicate like parts, and particularly to FIGS. 1 and 2, the tray for suspending from the neck, immediately below the chin, and for minimizing dribbling, dropping, and spilling of food, without the use of hands of the present invention is shown generally at 20 for suspending from the neck 22, immediately below the chin 24, and for minimizing dribbling, dropping, and spilling of food 26, without the use of hands 28.

The general configuration of the tray for suspending from the neck, immediately below the chin, and for minimizing dribbling, dropping, and spilling of food, without the use of hands 20 can best be seen in FIGS. 1 and 2, and as such, will be discussed with reference thereto.

The tray for suspending from the neck, immediately below the chin, and for minimizing dribbling, dropping, and spilling of food, without the use of hands 20 comprises a suspender 30 for hooking the neck 22 and a tray 32 suspended from the suspender 30 for holding the food 26.

The specific configuration of a first embodiment of the tray for suspending from the neck, immediately below the chin, and for minimizing dribbling, dropping, and spilling of food, without the use of hands 120 can best be seen in FIGS. 3–6, and as such, will be discussed with reference thereto.

The suspender 30 of the tray for suspending from the neck immediately below the chin, and for minimizing dribbling, dropping, and spilling of food, without the use of hands 120 is tubular and made from a semi-rigid wire 131 enclosed in a foam material 133 for minor adjustments and for preventing injury to the neck 22.

The suspender 30 of the tray for suspending from the neck immediately below the chin, and for minimizing dribbling, dropping, and spilling of food, without the use of hands 120 comprises a first portion 145 that originates at a free end 136, and extends straight and horizontally therefrom, to a second portion 138 that extends straight, horizontally, and perpendicularly forwardly from the first portion 134, to a third portion 140 that extends straight, horizontally, and perpendicularly from the second portion 138, parallel to the first portion 134, to a fourth portion 142 that extends straight, horizontally, and perpendicularly from the third portion 140, parallel to the second portion 138, and which terminates in an end 144.

The suspender 30 of the tray for suspending from the neck, immediately below the chin, and for minimizing dribbling, dropping, and spilling of food, without the use of hands 120 further comprises a first portion 146 that has one end 148 pivotally mounted to the end 144 of the fourth portion 142, by a pivot joint 149, and extends generally upwardly therefrom in a hook-like fashion to a free end 150 for hooking the neck 22.

The pivot joint 149 comprises a first collar 152 that is disposed on the end 144 of the fourth portion 142 for pivoting therewith and a second collar 154 that is disposed on the one end 148 of the fifth portion 146 for pivoting therewith, and which is pivotally mounted to the first collar 152 of the pivot joint 149, by a pivot pin 156.

The first portion 134, the second portion 138, the third portion 140, and the fourth portion 142 together define an opening 158.

the tray 32 of the tray for suspending from the neck, immediately below the chin, and for minimizing dribbling, dropping, and spilling of food, without the use of hands 120 comprises a receptacle 160 that is sized to fit in the opening 158 for holding the food 26, and which has an open top 161.

The tray 32 of the tray for suspending from the neck, immediately below the chin, and for minimizing dribbling, dropping, and spilling of food, without the use of hands 120 further comprises a flange 162 that extends around the open top 161 of the receptacle 160, and which interchangeably rests on the first portion 134, the second portion 138, the third portion 140, and the fourth portion 142 to prevent the receptacle 160 from falling through the opening 158.

Figure 8:
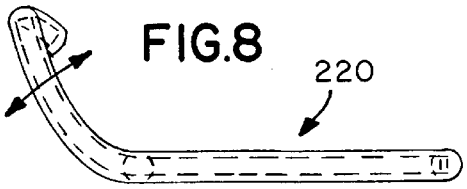
FIG. 8 is an enlarged diagrammatic side elevational view taken generally in the direction of arrow 8 in FIG. 7.
Figure 7:
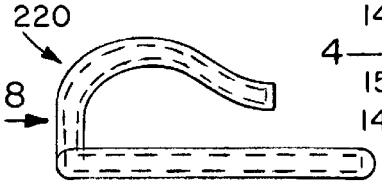
FIG. 7 is a diagrammatic top plan view of the area generally enclosed by the dotted curve identified by arrow 7 in FIGS. 1 and 2 of a second embodiment of the present invention.
Figure 3:
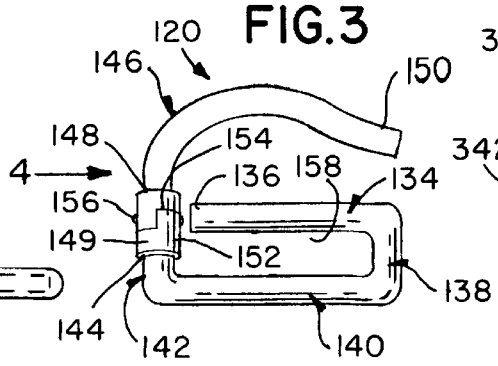
FIG. 3 is a diagrammatic top plan view of the area generally enclosed by the dotted curve identified by arrow 3 in FIGS. 1 and 2 of a first embodiment of the present invention.

The specific configuration of a second embodiment of the tray for suspending from the neck, immediately below the chin, and for minimizing dribbling, dropping, and spilling of food, without the use of hands 220 can best be seen in FIGS. 7 and 8, and as such, will be discussed with reference thereto.

The second embodiment of the tray for suspending from the neck, immediately below the chin, and for minimizing dribbling, dropping, and spilling of food, without the use of hands 220 is similar to the first embodiment of the tray for suspending from the neck, immediately below the chin, and for minimizing dribbling, dropping, and spilling of food, without the use of hands 120, except that the pivot joint 149 is deleted and the semi-rigid wire 131 enclosed in the foam material 133 provides for pivoting.

Figure 9:
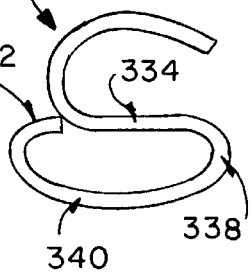
FIG. 9 is a diagrammatic top plan view of the area generally enclosed by the dotted curve identified by arrow 9 in FIGS. 1 and 2 of a third embodiment of the present invention.

The specific configuration of a third embodiment of the tray for suspending from the neck, immediately below the chin, and for minimizing dribbling, dropping, and spilling of food, without the use of hands 320 can best be seen in FIG. 9, and as such, will be discussed with reference thereto.

The third embodiment of the tray for suspending from the neck, immediately below the chin, and for minimizing dribbling, dropping, and spilling of food, without the use of hands 320 is similar to the second embodiment of the tray for suspending from the neck, immediately below the chin, and for minimizing dribbling, dropping, and spilling of food, without the use of hands 220, except that the first portion 334, the second portion 338, the third portion 340, and the fourth portion 342 are arcuate-shaped.

Figure 11:
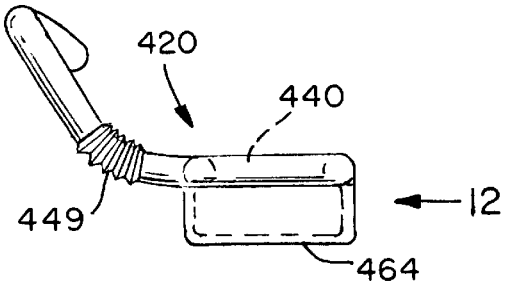
FIG. 11 is a diagrammatic side elevational view taken generally in the direction of arrow 11 in FIG. 10.
Figure 10:
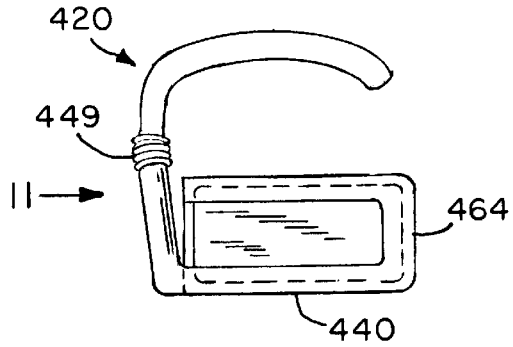
FIG. 10 is a diagrammatic top plan view of the area generally enclosed by the dotted curve identified by arrow 10 in FIGS. 1 and 2 of a fourth embodiment of the present invention.
Figure 12:
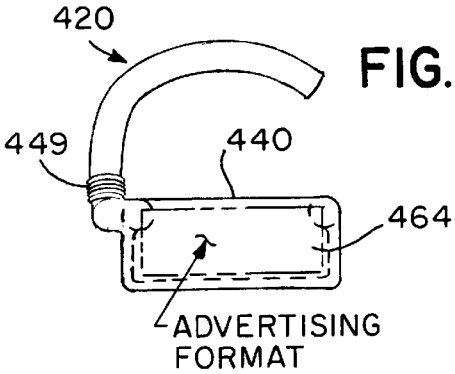
FIG. 12 is a diagrammatic front elevational view taken generally in the direction of arrow 12 in FIG. 11.

The specific configuration of a fourth embodiment of the tray for suspending from the neck, immediately below the chin, and for minimizing dribbling, dropping, and spilling of food, without the use of hands 420 can best be seen in FIGS. 10–12, and as such, will be discussed with reference thereto.

The fourth embodiment of the tray for suspending from the neck, immediately below the chin, and for minimizing dribbling, dropping, and spilling of food, without the use of hands 420 is similar to the first embodiment of the tray for suspending from the neck, immediately below the chin, and for minimizing dribbling, dropping, and spilling of food, without the use of hands 120, except that the pivot joint 149 is replaced with a semi-rigid and slightly adjustable bellows 449 for permitting adjustment, and an advertising format 464 that extends from the third portion 440 is added.

Figure 13:
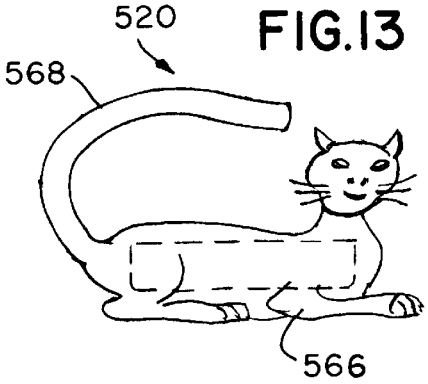
FIG. 13 is a diagrammatic top plan view of the area generally enclosed by the dotted curve identified by arrow 13 in FIGS. 1 and 2 of a fifth embodiment of the present invention.

The specific configuration of a fifth embodiment of the tray for suspending from the neck, immediately below the chin, and for minimizing dribbling, dropping, and spilling of food, without the use of hands 520 can best be seen in FIG. 13, and as such, will be discussed with reference thereto.

The fifth embodiment of the tray for suspending from the neck, immediately below the chin, and for minimizing dribbling, dropping, and spilling of food, without the use of hands 520 is similar to the second embodiment of the tray for suspending from the neck, immediately below the chin, and for minimizing dribbling, dropping, and spilling of food, without the use of hands 220, except that the first portion 134, the second portion 138, the third portion 140, and the fourth portion 142 are shaped like a cat 566, and the fifth portion 142 is shaped like the tail 568 of the cat 566.

Figure 14:
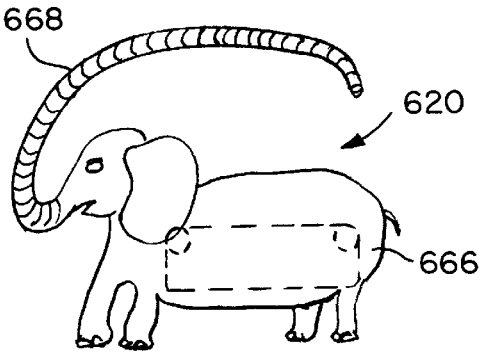
FIG. 14 is a diagrammatic view of the area generally enclosed by the dotted curve identified by arrow 14 in FIGS. 1 and 2 of a sixth embodiment of the present invention.

The specific configuration of a sixth embodiment of the tray for suspending from the neck, immediately below the chin, and for minimizing dribbling, dropping, and spilling of food, without the use of hands 620 can best be seen in FIG. 14, and as such, will be discussed with reference thereto.

The sixth embodiment of the tray for suspending from the neck, immediately below the chin, and for minimizing dribbling, dropping, and spilling of food, without the use of hands 620 is similar to the second embodiment of the tray for suspending from the neck, immediately below the chin, and for minimizing dribbling, dropping, and spilling of food, without the use of hands 220, except that the first portion 134, the second portion 138, the third portion 140, and the fourth portion 142 are shaped like an elephant 666, and the fifth portion 142 is shaped like the trunk 668 of the elephant 666.

It will be understood that each of the elements described above, or two or more together, may also find a useful application in other types of constructions differing from the types described above.

While the invention has been illustrated and described as embodied in a tray for suspending from the neck, immediately below the chin, and for minimizing dribbling, dropping, and spilling of food, without the use of hands, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A device for suspending from the neck, immediately below the chin, and for minimizing dribbling, dropping, and spilling of food, without use of hands, said device comprising:

a) a suspender for hooking the neck; and b) a tray suspended from said suspender for holding the food, wherein said suspender is tubular and made from a semi-rigid wire, for minor adjustments, that is enclosed in a foam material for preventing injury to the neck, wherein said suspender comprises a first portion that originates at a free end, and extends horizontally therefrom, to a second portion that extends horizontally forwardly from said first portion of said suspender, to a third portion that extends horizontally from said second portion of said suspender, to a fourth portion that extends horizontally from said third portion of said suspender, and which terminates in an end.

2. The device as defined in claim 1, wherein said first portion of said suspender extends straight, said second portion of said suspender extends straight and perpendicularly forwardly from said first portion of said suspender, said third portion of said suspender extends straight and perpendicularly from said second portion of said suspender, parallel to said first portion of said suspender, and said fourth portion of said suspender extends straight and perpendicularly from said third portion of said suspender, parallel to said second portion of said suspender.

3. The device as defined in claim 1, wherein said first portion of said suspender extends arcuately, said second portion of said suspender extends arcuately forwardly from said first portion of said suspender, said third portion of said suspender extends arcuately from said second portion of said suspender, and said fourth portion of said suspender extends arcuately from said third portion of said suspender.

4. The device as defined in claim 1, wherein said suspender further comprises a fifth portion that has one end pivotally mounted to said end of said fourth portion of said suspender, by a pivot joint, and extends generally upwardly therefrom in a hook-like fashion to a free end for hooking the neck.

5. The device as defined in claim 4, wherein said first portion of said suspender, said second portion of said suspender, said third portion of said suspender, and said fourth portion of said suspender are shaped like a cat, and said fifth portion of said suspender is shaped like the tail of said cat.

6. The device as defined in claim 4, wherein said first portion of said suspender, said second portion of said suspender, said third portion of said suspender, and said fourth portion of said suspender are shaped like an elephant, and said fifth portion of said suspender is shaped like the trunk of said elephant.

7. The device as defined in claim 4, wherein said pivot joint comprises a first collar that is disposed on said end of said fourth portion of said suspender for pivoting therewith and a second collar that is disposed on said one end of said fifth portion of said suspender for pivoting therewith, and which is pivotally mounted to said first collar of said pivot joint, by a pivot pin.

8. The device as defined in claim 4, wherein said pivot joint comprises a semi-rigid and slightly adjustable bellows for permitting adjustment.

9. The device as defined in claim 4, wherein said pivot joint comprises said suspender being made from a semi-rigid wire that is enclosed in a foam material.

10. The device as defined in claim 1, wherein said first portion of said suspender, said second portion of said suspender, said third portion of said suspender, and said fourth portion of said suspender together define an opening.

11. The device as defined in claim 10, wherein said tray comprises a receptacle that is sized to fit in said opening in said suspender for holding the food, and which has an open top.

12. The device as defined in claim 11, wherein said tray further comprises a flange that extends around said open top of said receptacle of said tray, and which interchangeably rests on said first portion of said suspender, said second portion of said suspender, said third portion of said suspender, and said fourth portion of said suspender to prevent said receptacle of said tray from falling through said opening in said suspender.

13. The device as defined in claim 1, further comprising an advertising format extending from said third portion of said suspender.

14. The device as defined in claim 1, wherein said suspender is formed by a single piece mold for permitting a manufacturing process which is inexpensive and simple.

15. The device as defined in claim 1, wherein said suspender and said tray are integrally formed of papermache-like material for being inexpensive, easily formed, and adequately strong when formed in a U-channel shape.

16. The device as defined in claim 1, wherein said suspender and said tray are created of a material for preventing a personal hazard in a crash.

17. The device as defined in claim 1, wherein said suspender and said tray are created of a material for being readily disposable and biodegradable.

18. The device as defined in claim 1, wherein said tray is shaped to include a reservoir for containing drips and spills falling therein.

* * * * *